US007979947B2

(12) United States Patent
Storkel et al.

(10) Patent No.: US 7,979,947 B2
(45) **Date of Patent: *Jul. 19, 2011**

(54) TOOTHBRUSH

(75) Inventors: Jens Storkel, Frankfurt (DE); Florina Winter, Schmitten (DE); Manfred Klawuhn, Frankfurt am Main (DE); Gerhard Schafer, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/844,107

(22) Filed: Jul. 27, 2010

(65) Prior Publication Data

US 2010/0306943 A1 Dec. 9, 2010

Related U.S. Application Data

(63) Continuation of application No. 10/564,508, filed on May 11, 2006, now Pat. No. 7,814,606.

(51) Int. Cl.
*A46B 9/04* (2006.01)

(52) U.S. Cl. ..... 15/167.1; 15/191.1; 15/201

(58) Field of Classification Search ..... 15/28, 167.1, 15/191.1, 195, 201; D4/104, 105
See application file for complete search history.

(56) References Cited

U.S. PATENT DOCUMENTS

| | | | |
|---|---|---|---|
| 3,229,318 | A | 1/1966 | Clemens et al. |
| 3,638,285 | A | 2/1972 | Humberto et al. |
| 4,635,313 | A | 1/1987 | Fassler et al. |
| 4,988,146 | A | 1/1991 | Weihrauch |
| 5,687,446 | A | 11/1997 | Chen et al. |
| 5,802,656 | A | 9/1998 | Dawnson et al. |
| 6,553,604 | B1 | 4/2003 | Braun et al. |
| 6,735,804 | B2 | 5/2004 | Carlucci et al. |
| 2004/0130203 | A1 | 7/2004 | Driesen et al. |

FOREIGN PATENT DOCUMENTS

| | | |
|---|---|---|
| DE | 1 942 535 | 7/1966 |
| EP | 0 471 312 | 2/1992 |
| EP | 0 894 454 | 2/1999 |
| EP | 1 138 222 | 10/2001 |
| FR | 2 548 528 | 8/1983 |
| WO | WO 01/17433 | 3/2001 |
| WO | WO 01/89344 | 11/2001 |

OTHER PUBLICATIONS

Office Action for U.S. Appl. No. 10/564,508 dated Aug. 14, 2009; P&G Case Z-7893Q; Storkel et al.; filed Jan. 11, 2006.

*Primary Examiner* — Mark Spisich
(74) *Attorney, Agent, or Firm* — George H. Leal

(57) ABSTRACT

A toothbrush having a head with a first end and a second end with peripheral edge regions extending between the first end and the second end is described. The head includes a first surface and a second surface opposite the first surface. The first surface includes raised portions and depressed portions, wherein the depressed portions are adjacent the peripheral edge regions. A first plurality of cleaning elements protrude from the first surface, and a second plurality of cleaning elements protrude from the first surface. Each of the first plurality of cleaning elements protrudes from a depressed portion and has a cross section. Each of the depressed portions has the same cross section as each of the first plurality of cleaning elements.

3 Claims, 2 Drawing Sheets

Figure 6:
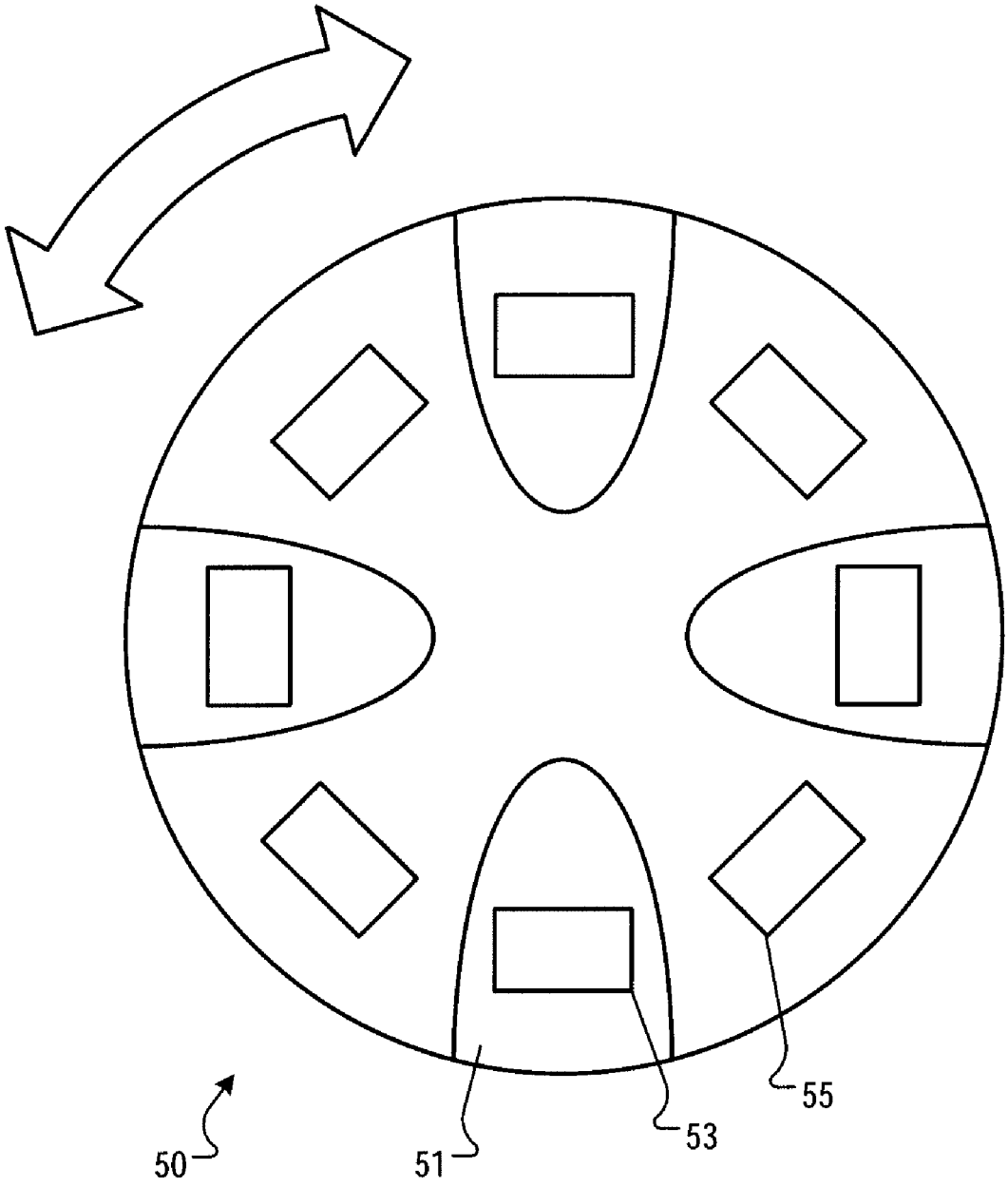

Fig. 1
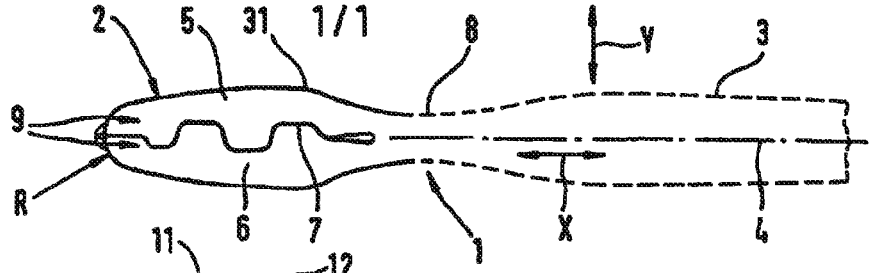
Fig. 2
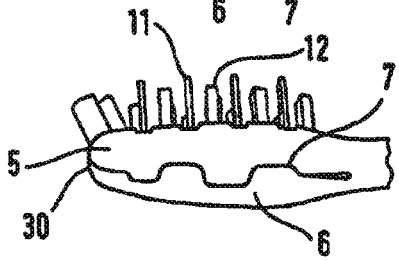
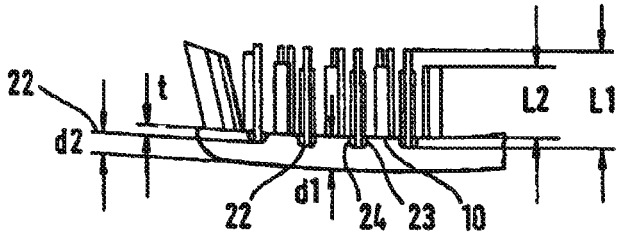
Fig. 3
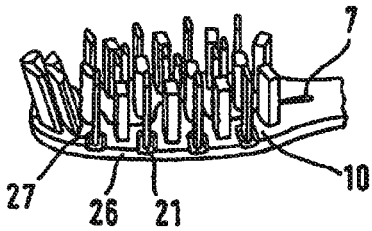
Fig. 4
Fig. 5
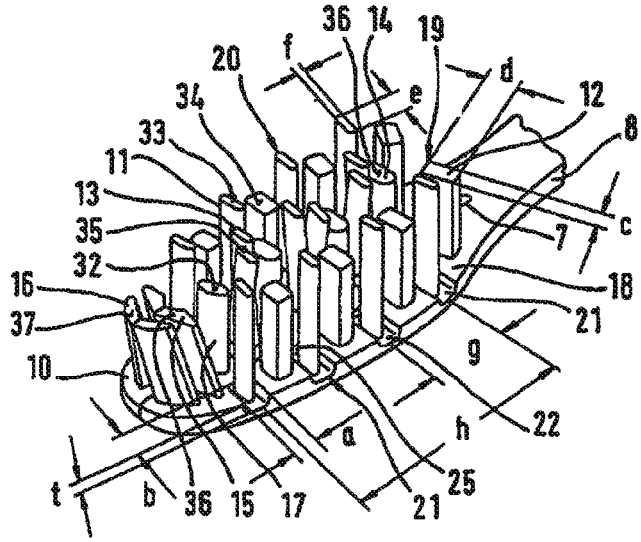

TOOTHBRUSH

CROSS REFERENCE

This application is a continuation of U.S. patent application Ser. No. 10/564,508, now U.S. Pat. No. 7,814,606, the contents of which are incorporated by reference.

The invention pertains to a toothbrush with a brush head, wherein bristle clusters protrude from a surface of said brush head.

A toothbrush of this type is already known from German Utility Model 77 15 006. This toothbrush is provided with a slotted or perforated plate, through the slots or perforations of which bristle clusters protrude upward. The slotted or perforated plate is provided with a manually actuated adjusting device that makes it possible to vary the distance between the slotted or perforated plate and the surface, from which the bristle clusters protrude, namely in such a way that the free length of the bristle clusters can be respectively extended or shortened. This makes it possible to respectively decrease or increase the hardness of the toothbrush. One less advantageous aspect of this arrangement can be seen in that—leaving aside the already costly construction—only the freely protruding length of all bristle clusters arranged on the brush head is varied with a single adjustable slotted or perforated plate, respectively.

U.S. Pat. No. 2,274,042 discloses a manually operated toothbrush, in which bristle clusters of identical dimensions protrude from the toothbrush head, namely from surfaces thereof that are arranged at different heights. The quality as well as the length and the thickness of all bristle clusters are identical such that the flexural strength of all bristle clusters is also identical. Although the brushing ends of a few bristle clusters protrude from the brushing plane such that they respectively lie above or below the brushing ends of other bristle clusters, all bristle clusters have the same flexural strength because they protrude by the same length.

A manually operated toothbrush is also known from U.S. Pat. No. 6,553,604, wherein bristle clusters of different cross sections protrude from a surface of the brush head of this toothbrush. In this case, bristle clusters situated on the edge are arranged in openings that are larger than the cross section of the individual bristle clusters such that they are flexible in the longitudinal direction of the manually operated toothbrush. This enables these bristle clusters to better penetrate into the interdental spaces when the toothbrush is moved back and forth while brushing the teeth. The bristle clusters are supported in the recesses by means of barrel-shaped thickenings arranged on their ends. Although a toothbrush of this type functions well, its manufacture and assembly are more costly than those of conventional toothbrushes.

The invention is based on the objective of developing a toothbrush with a brush head according to the preamble, in which simple means respectively make it easier or more difficult for individual bristle clusters of the brush head to move back and forth than other bristle clusters of the brush head. The invention also aims to improve the cleaning result, particularly in the region of the interdental spaces, wherein the toothbrush also has a simple design and can be inexpensively manufactured with simple manufacturing techniques.

This objective is attained with the characteristics disclosed in the characterizing portion. The arrangement of an annular depression around an individual bristle cluster results in this bristle cluster having a different flexural strength than adjacent bristle clusters that are not arranged in such an annular depression, wherein this comparison naturally is based on the individual bristle clusters having the same quality and the same dimensions. The variation of the free bending length—at otherwise unchanged tuft parameters such as filament diameter, filament material and filament quantity—causes the bristles of this tuft or this bristle cluster to become freely movable and therefore promotes the cleaning effect of the toothbrush similarly well as it is the case with U.S. Pat. No. 6,553,604.

The annular depression or the depression extending around a bristle cluster can be manufactured in a particularly simple fashion if—in contrast to fixing the bristle clusters in bore holes of the brush head by means of anchors—a plastic mass is injection-moulded around the free ends of the bristle clusters in order to fix the bristle clusters on the brush head that is formed by the thusly moulded plastic mass in this case. The injection-moulding tool used for moulding the brush head merely needs to be provided with corresponding elevations that produce the annular depressions on the brush head during the injection-moulding process. Since only an annular depression needs to be realized around individual bristle clusters, it is possible to position such a depression around any bristle cluster of the brush head without a significant technical expenditure, namely in dependence on the positions of the brush head, at which harder or softer bristle clusters should be arranged. This makes it possible to realize a superior flexural strength of individual bristle clusters and therefore a superior flexural strength of the entire bristle section. The object of the invention is suitable for use in connection with manually operated toothbrushes as well as electric toothbrushes with an oscillating round brush head, for example, according to EP 1 138 222 A2 or EP 0 765 642 A2.

The characteristics make it possible to better adapt the shape of an annular depression to the cross section of a bristle cluster protruding from the bottom of the annular depression. This has the advantage that the base of the bristle cluster is essentially always spaced apart from the edge of the annular depression by the same distance and therefore occupies the least space possible on the brush head.

When utilizing a bristle cluster of essentially rectangular cross section with rounded corners, it is preferred to choose a peripheral depression of essentially rectangular cross section with rounded corners, i.e., an annular depression, the walls of which extend parallel to and are slightly spaced apart from the outer walls of a bristle cluster. However, when a bristle cluster is used that has, for example, a round or oval cross section, the annular depression also has a round or oval cross section. When using a bristle cluster of star-shaped or other cross section, the shape of the annular depression is also correspondingly adapted to this cross section.

If the longer cross-sectional sides of the bristle clusters extend transverse to the longitudinal direction of the brush head, this cross-sectional shape has a relatively low flexural strength in the longitudinal direction of the toothbrush head and a relatively high flexural strength in the direction extending transverse thereto. When the toothbrush is moved transverse to the longitudinal direction of the teeth, the corresponding bristles can easily penetrate into the interdental spaces due to their relatively low flexural strength. However, when the toothbrush is moved in the longitudinal direction of the teeth, i.e., in the direction in which the bristle clusters have a higher flexural strength and therefore are relatively stiff, they are not significantly bent and therefore can be guided through the interdental spaces quite well while very effectively removing particles therefrom. This results in a very good cleaning effect on the surface of the teeth, as well as in the interdental spaces. The toothbrush may consist of a manually operated toothbrush, in which case the hand needs to mechanically carry out all brushing movements, or of an electric toothbrush that carries out a reciprocating brushing movement or even a vibratory oscillating movement.

If the depressions are arranged on the edge of the brush head in accordance with the characteristics, the bristle clusters protruding from the annular depressions are particularly effective in cleaning the teeth because they are able to penetrate particularly well into the interdental spaces when the brush head is customarily turned slightly about its longitudinal axis. In this case, the bristle clusters situated on the edge are used more intensely than the centrally arranged bristle clusters.

According to the characteristics, the annular depressions are laterally tapered off, i.e., they are not outwardly enclosed by a wall. This has the advantage that particles deposited in the annular depressions can be easily washed out laterally when the brush head is cleaned. The annular depressions can be easily rinsed out in this fashion.

According to the characteristics, several annular depressions with bristle clusters protruding therefrom are provided on the lateral edges of the brush head in order to achieve a superior interdental cleaning effect, in particular, in the edge region. Additional bristle clusters are arranged between the individual bristle clusters protruding from the annular depressions, wherein these additional bristle clusters are not surrounded by annular depressions and, assuming they have the same cross-section, consist of the same bristle material and end in the same brushing plane of the brush head, have a higher flexural strength than the bristle clusters according to the invention because their base is embedded to a higher elevation.

If the bristle clusters arranged at a higher elevation also have a thicker cross section and a shorter length than the bristle clusters provided with the annular depressions as proposed, the bristle clusters protruding from the annular depressions are activated better and more intensely while brushing the teeth and therefore have a significantly improved interdental cleaning effect. This is achieved, in particular, in that the shorter bristle clusters of thicker cross section that also lie at a higher elevation do not become effective in cleaning the teeth until the free ends of the bristle clusters of smaller cross section that protrude from the annular depressions are deformed by the teeth, pushed sideward and penetrate into the individual gaps.

According to the characteristics, four annular depressions with one respective bristle cluster protruding therefrom are respectively provided to both sides of the brush head. This number of annular depressions proved most advantageous for manually operated toothbrushes designed for adults, namely because a sufficient distance in the longitudinal direction lies between the individual bristle clusters in this case such that they are able to bend sufficiently while brushing the teeth without interfering with one another. However, if the bristle clusters protruding from the depressions as well as the shorter bristle clusters arranged in between have a smaller cross section, it would be possible to arrange more than four annular depressions with bristle clusters protruding therefrom in the longitudinal direction. Smaller brush heads can also be provided with less than four annular depressions with bristle clusters protruding therefrom, e.g., three or two annular depressions.

A very good penetration of the bristle clusters protruding from the annular depressions is achieved with the characteristics disclosed. When brushing the teeth, these longer bristle clusters come in contact with the surface of the teeth first and therefore are also subjected first to a force in the longitudinal direction or transverse thereto, respectively. Consequently, these longer bristle clusters are able to better penetrate into the interdental spaces before the shorter bristle clusters arranged in between come in contact with the surface of the teeth. The shorter bristle clusters begin to clean the surface of the teeth as additional pressure is exerted upon the toothbrush.

According to the characteristics, the toothbrush head can be realized in an even more flexible and elastic fashion such that the penetration of the bristle clusters protruding from the annular depressions into the interdental spaces is additionally simplified.

The characteristics enable the left side to move independently of the right side of the brush head such that the bristles become more resilient and even more elastic. Therefore, they are also able to better follow the contour of the teeth and to penetrate into many uneven areas on the tooth surface.

According to the characteristics, the invention is used in connection with a round brush head of an electric toothbrush that is driven by an electric drive such that it carries out an oscillating rotational movement, wherein the longer side of the rectangle of the annular depression essentially extends in the circumferential direction of the round brush head in this case. This arrangement ensures that the bristle clusters protruding from the annular depressions can be deformed more easily in the circumferential direction than transverse to the moving direction of the drive segment of the electric toothbrush due to their lower flexural strength. An improved penetration into the interdental spaces is also achieved in this case. However, these bristle clusters have a higher flexural strength when the round toothbrush head is moved in the longitudinal direction of the interdental space(s) and therefore are able to better transport particles out of the interdental spaces.

The characteristics reflect the characteristics of a manually operated toothbrush, but pertain to a round toothbrush head. In order to prevent unnecessary repetitions, we refer to the above-discussed advantages that consequently can be realized analogously with a round toothbrush head.

One embodiment of the invention is illustrated in the figures and described in greater detail below.

The figures show:

FIG. 1, a top view of the rear side of the toothbrush, wherein the handle is drawn with broken lines and only its front end is shown;

FIG. 2, a perspective representation of the rear side of the brush head according to FIG. 1, however, without an illustration of the handle;

FIG. 3, a side view of the brush head according to FIG. 2;

FIG. 4, a perspective representation of the brush head according to FIG. 3, and FIG. 5, a representation of the brush head that is almost identical to that shown in FIG. 4, however, on an enlarged scale.

FIG. 6, a representation of a brush head of another embodiment.

The toothbrush 1 consists of a brush head 2 and a handle 3 that is only partially illustrated with broken lines in FIG. 1 and not shown at all in FIGS. 2-5. In FIGS. 1-5, the brush head 2 consists of two brush head halves 5, 6 that are divided in the longitudinal direction 4 of the toothbrush 1 and separated from one another by a centrally extending S-shaped slot 7. The slot 7 begins a short distance behind the handle 3, namely on the neck 8 that forms the transition to the brush head 2 as clearly illustrated in FIG. 1. Behind the neck 8, the brush head 2 abruptly widens in the direction toward the point 30 until the widest points 31 are reached. The edges 26 are then continuously tapered toward the point 30 from these widest points. The edges 26 are smoothly connected to one another at the point 30 with a radius R.

Different groups of bristle clusters 11, 12, 13, 14, 15, 16 and 17 protrude from the entire surface 10 of the brush head 2 that lies opposite of the rear side 9, wherein said bristle clusters consist of many individual fine bristles or filaments (individual bristles are not illustrated) that respectively have the same length within a cluster. The bristle clusters 11, 12, 13, 14, 15, 16 and 17 have different cross sections, different lengths and different qualities.

The bristle clusters 11 according to FIG. 5 have an essentially rectangular cross section with slightly rounded corners 20. The cross section of the bristle clusters 11 is defined by the longitudinal side e and the broadside f. The rectangular cross section of the bristle clusters 11 may also be slightly oval, i.e., the broadside f may be formed, for example, by an outwardly curved radius that seamlessly connects the two longer side walls 23, 24 to one another rather than a straight line. The surface 10 extends essentially parallel to the rear side 9 that is slightly curved outward and flattened toward the edges such that the thickness of the brush head 2 slightly decreases toward the edge. Depending on how the bristle clusters 11, 12, 13, 14, 15, 16 and 17 are arranged relative to the surface 10 and the longitudinal axis 4 of the handle 3 in order to achieve the best cleaning result, the surface 10 may, however, also extend horizontally or at an incline referred to the longitudinal axis 4 of the handle 3.

The surface 10 shown in FIGS. 1-5 contains annular depressions 21 that are arranged in the edge region 18 of the brush head 2 and respectively defined by the bottom 22, the longer side walls 23, 24 and a shorter side wall 25. The annular depressions 21 provided on both brush head halves 5, 6 extend as far as the nearest edge 26, where they are tapered off such that shorter side walls analogous to those on the opposite side are not formed at these locations. The longer side walls 23, 24 extend transverse to the longitudinal direction 4 of the manually operated toothbrush 1. The bottoms 22 essentially extend perpendicular to the bristle clusters 11, and the side walls 23-25 extend essentially parallel to the bristle clusters. The transition from the side walls 23-25 to the bottom 22 is realized with small radii such that sharp edges are prevented and rounded edges 27 are formed in these regions. If viewed in the form of a top view, the annular depressions 21 have an essentially rectangular cross section analogous to the cross section of the bristle clusters 11. Their long side b has a length between 3 and 4 mm, preferably 3.5 mm. Their broadside a has a length between 2 and 3 mm, preferably 2.5 mm. The depth t measured from the surface 10 to the bottom 22 of the annular depression lies between 1 and 2 mm, preferably at 1.4 mm.

The bristle clusters 11 protrude upward from the bottoms 22 of the individual annular depressions 21. The free length L1 measured from the bottom 22 to the free end 20 of the bristle cluster 11 lies between 12 and 14 mm, preferably at 13 mm (FIG. 3). The longitudinal side e of the bristle clusters 11 has a length between 2.1 and 2.4 mm, preferably 2.3 mm, and the broadside f of the bristle clusters 11 has a length between 0.7 and 0.8 mm, preferably 0.75 mm. The longitudinal side e extends transverse to the longitudinal direction 4 of the manually operated toothbrush 1, i.e., the bristle clusters 11 have a lower flexural strength in the brushing direction X than in the brushing direction Y.

According to FIG. 3, the height of the brush head is composed of the dimensions d2 and t and therefore amounts to 3.5-5 mm, preferably 4.1 mm. Naturally, these "preferred" dimensions may also be shorter or longer. In FIG. 3, the thickness d2 measured from the bottom 22 of the annular depression 21 to the underside 9 of the brush head 2 lies between 2.5 and 3 mm, preferably at 2.7 mm.

FIGS. 2-5 show that the bristle clusters 11 are arranged in the form of a successive row in the edge region 18 and centrally protrude upward from the annular depressions. Bristle clusters 12 protrude upward from the surface 10 between the annular depressions 21, wherein these bristle clusters have a larger cross section than the bristle clusters 11, but their longitudinal sides d also extend essentially transverse to the longitudinal axis 4 of the manually operated toothbrush 1. The longitudinal side d of a bristle cluster 12 has a length between 2.2 and 2.8 mm, preferably 2.5 mm, and the broadside c has a length between 1.6 and 2 mm, preferably 1.8 mm. Their length measured from the surface 10 to the free ends 29 lies between 9 and 10 mm, preferably at 9.5 mm. Another bristle cluster 12 is arranged adjacent to the bristle cluster 11 situated nearest the neck 8 such that four bristle clusters 11 and 4 bristle clusters 12 are alternately arranged in a row in the edge region 18. Since the bristle clusters 11, 12 need to have a constant distance from the edge 26 but this edge is slightly curved outward, the row of bristle clusters 11, 12 also has a slight outward curvature. According to FIG. 5, four bristle clusters 11 are respectively arranged successively in a row along the lateral edges 18 and spaced apart by a distance g, wherein this distance g lies between 3 and 3.5 mm, preferably at 3.2 mm. The distance h between the rearmost and the foremost bristle cluster 11 lies between 18 mm and 21 mm, preferably at 19.6 mm.

The bristle clusters 11 have a different color such that they can be distinguished from the bristle clusters 12-17, wherein this is indicated in FIGS. 2-5 by the darker manner of representation.

The cross sections of the bristle clusters 12 are also rounded on the corners 19 in order to prevent sharp edges and to realize a simple manufacture.

Additional bristle clusters 13, 14, 15 and 17, all of which protrude upward from the surface 10, are arranged within the bristle clusters 11, 12 situated in the edge region 18. These additional bristle clusters may also extend perpendicular to the surface 10 or have a slight forward or rearward or sideward incline. The bristle clusters 13, 14 also have an essentially rectangular or slightly oval cross section. With respect to the rectangular cross section, the shorter sides can once again be formed by outwardly curved radii in this case. The front region is provided with a bristle cluster 17 of round cross section, the free end of which is inclined toward the handle 3 and in the direction of the surface 10.

The free ends 33, 34, 35 of the bristle clusters 11, 12, 13 extend essentially parallel to the surface 10 of the brush head 2, but may also be slightly inclined forward or rearward if this improves the cleaning result. The free ends 33 of the bristle clusters 11 protrude upward beyond the free ends 34 of the bristle clusters 12 by a short distance in order to achieve a superior penetration into the interdental spaces.

The front region of the brush head 2, i.e., the region situated in front of the first bristle cluster 11 and the bristle cluster 17, merely contains two essentially lunulate bristle clusters 15, 16 that are inclined toward the front and the surfaces of which are inclined rearward in the direction of the handle 4 and in the direction of the surface 10 on their free ends 36, 37. The bristle clusters 15, 16 are divided into two halves by the slot 7. These bristle clusters are designed, in particular, for cleaning the rear molar region while brushing the teeth.

The bristle clusters 11, 12 consist of many individual bristles or filaments (that are not illustrated in the figures). The bristles of the bristle clusters 11 preferably have a thickness of 0.008 inch, and the bristles of the bristle clusters 12 have a thickness of 0.006 inch. Due to the greater thickness of the filaments that form the bristle clusters 11, these filaments also have a superior durability, i.e., the thickness and the quality of the individual filaments, as well as the number of the individual filaments in a bristle cluster 11, are chosen such that these bristle clusters do not wear out faster than the bristle clusters 12-17 and the state of wear of all bristle clusters of a toothbrush 1 appears to be approximately identical.

The manually operated toothbrush shown in FIGS. 1-5 functions as described below:

When using the toothbrush such that the free ends 32-37 of the bristle clusters 11-17 move in the direction X, i.e., transverse to the teeth in the mouth while being essentially arranged perpendicular thereto, the free ends 33 of the bristle clusters 11 are pressed against the surface of the teeth first. This causes these bristle clusters to deflect or bend opposite to the moving direction X until the free ends 33 of the bristle clusters 11 slide into the interdental spaces. During this process, these bristle clusters press particles out of the interdental spaces. The free ends 34 of the bristle clusters 12 simultaneously come in contact with and clean the front surfaces of the teeth. [In the moving direction X,] the bristle clusters 11 can be deformed much easier in the direction X than the bristle clusters 12 because they have a smaller cross section and a greater protruding length than the bristle clusters 12. The superior elastic bending properties of the bristle clusters 11, as well as their slender cross section, promotes the penetration of their free ends 33 into the interdental spaces while brushing the teeth such that the cleaning result is improved.

If the toothbrush 1 is moved back and forth in the direction Y as shown in FIG. 1, the free ends 32 of the bristle clusters 11 initially penetrate into the interdental spaces and press particles out of these interdental spaces because the flexural strength is greater in the direction Y than in the direction X, i.e., the interdental spaces can be cleaned particularly well by moving the toothbrush in the direction Y. The width f of the bristle clusters 11 is chosen such that the free ends 32 are able to penetrate well into the interdental spaces. At least some of the bristle clusters 11 penetrate into the interdental spaces even if the interdental spaces are very small. In this respect, it is also advantageous that the individual bristles have a larger diameter than those of the bristle clusters 12 because this enables the bristles of the bristle clusters 11 to offer greater resistance to particles lodged in the interdental spaces.

When brushing the teeth, the toothbrush 1 is moved in the X-direction as well as in the Y-direction. This mixed movement results in a combination of the above-described advantages such that very good cleaning results are achieved. Adequate cleaning results can also be achieved with an electric toothbrush with a round oscillating brush head, for example, according to EP 1 138 222 A2 or EP 0 765 642 A2. In such a (not-shown) round brush head in which the bristle clusters are annularly arranged on the brush head surface, bristle clusters 11 and bristle clusters 12 according to FIGS. 1-5 are arranged on the outer edge and the annular depressions as well as the bristle clusters that protrude upward from these depressions extend concentric to the round toothbrush on its edge region. The free length L1 of the bristle clusters 11 is also longer in this case because they protrude upward from the bottom 22 of the annular depressions 21 rather than the surface 10 as shown in FIGS. 1-5. Additional figures of this embodiment are not provided because the annular depressions analogously extend along the edge in a round toothbrush.

We claim:

1. A toothbrush comprising:

a head having a first end and a second end with peripheral edge regions extending between the first end and the second end, the head further comprising a first surface and a second surface opposite the first surface, wherein the first surface includes raised portions and depressed portions, wherein the depressed portions are adjacent the peripheral edge regions, and wherein the depressed portions are not enclosed by a wall on the peripheral edge region;

a first plurality of cleaning elements protruding from the first surface; and a second plurality of cleaning elements protruding from the first surface, wherein the each of the first plurality of cleaning elements protrudes from a depressed portion and where each of the second plurality of cleaning elements extends from a raised portion, wherein each of the first plurality of cleaning elements comprises a cross sectional shape and wherein each of the depressed portions comprise the same cross sectional shape.

2. The toothbrush of claim 1, wherein each of the first plurality of cleaning elements is arranged such that longer cross sectional sides of the each of the first plurality of cleaning elements extends transverse to a longitudinal axis of the toothbrush.

3. The toothbrush of claim 1, wherein the head is divided into two portions which can move relative to one another.

* * * * *